United States Patent [19]

Kiedaisch et al.

[11] 4,372,599

[45] Feb. 8, 1983

[54] CROWN SUPPORT BEVERAGE CARRIER

[75] Inventors: Randall A. Kiedaisch, Deforest, Wis.; Leonard M. Cooper, Bradley, Ill.

[73] Assignee: Manville Service Corporation, Denver, Colo.

[21] Appl. No.: 239,816

[22] Filed: Mar. 2, 1981

[51] Int. Cl.[3] ..... B65D 71/00

[52] U.S. Cl. ..... 294/87.2; 206/153; 206/158

[58] Field of Search ..... 294/87.2, 87.28; 206/145, 147, 152, 153, 155, 158, 161, 170, 186–188, 427

[56] References Cited

U.S. PATENT DOCUMENTS

| | | | |
|---|---|---|---|
| 3,311,402 | 3/1967 | Spandock | 294/87.2 |
| 3,410,596 | 11/1968 | Slevin | 294/87.2 |
| 3,528,697 | 9/1970 | Wood | 294/87.2 |
| 4,273,273 | 6/1981 | Zenri | 294/87.2 |
| 4,305,500 | 12/1981 | Jaeschke | 294/87.2 X |
| 4,318,476 | 3/1981 | Wood et al. | 294/87.2 X |

FOREIGN PATENT DOCUMENTS

| | | | |
|---|---|---|---|
| 1493669 | 9/1967 | France | 206/153 |
| 984449 | 2/1965 | United Kingdom | 294/87.2 |

*Primary Examiner*—Johnny D. Cherry

*Attorney, Agent, or Firm*—Ronald M. Halvorsen; John D. Lister

[57] ABSTRACT

A crown support beverage carrier of the type designed to carry at least two bottles firmly locked within the carrier by the necks of the bottles with the carrier comprising an elongated inverted V-shaped upper section having formed therein bottle neck receiving openings which receive the necks of the beverage bottles and firmly retain the beverage bottles in the openings. A pair of side walls are hingedly attached to the inverted V-shaped upper section and a pair of end walls are hingedly attached to the pair of side walls.

2 Claims, 5 Drawing Figures

10
4
30
12
34
30
26
34
32
24
22
4
2
32
14
18
16
20
2
28
28

34
12
36
20
28

42
46
82
78
86
74
16
38
70
14
18
5
5

66
18
56
82
78
16
86
74
38
90
70
24
24
90
16
58
20
66

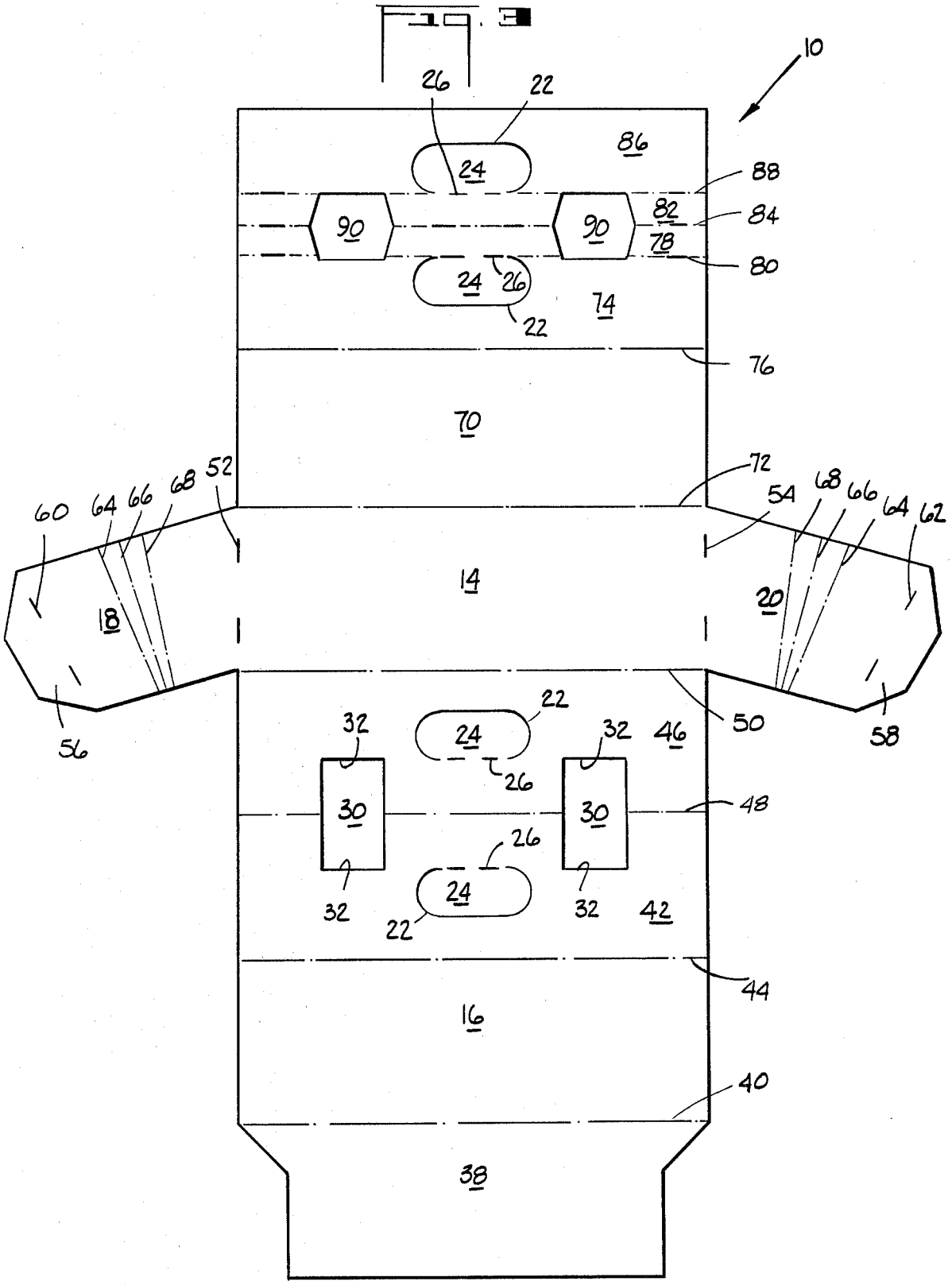
10
26
22
24
86
88
90
90
82
84
78
80
24
26
22
74
76
70
72
52
54
60
64
66
68
68
66
64
62
14
18
20
56
58
50
22
32
24
32
46
26
30
30
48
26
24
32
32
42
22
44
16
40
38

CROWN SUPPORT BEVERAGE CARRIER

BACKGROUND OF THE INVENTION

This invention relates to a beverage carrier and more particularly to a new and improved crown support beverage style carrier having additional graphic area on the carrier for advertising usage.

It is known in the prior art of crown support beverage carriers to provide various configurations of carriers which are designed to snap over the sealing caps of the beverage bottles with the carrier being utilized to transport the plurality of bottles contained in the carrier. Many configurations of carriers have been designed according to the desires of the bottler and keeping in mind the aesthetics of the package since it will be ultimately purchased by a consuming public.

It is desirous in the design of a crown support carrier to provide a strong carrier while using lighter amounts of paperboard in order to minimize the ultimate cost of the carrier which must be passed on to the consumer. It is also desirous to provide a carrier which has maximum amounts of graphic area upon which may be placed the advertising matter necessary to encourage the consuming public to purchase the product.

SUMMARY OF THE INVENTION

In order to provide the necessary features desired by some customers, there has been provided by the subject invention, a new and improved crown support beverage carrier of the type designed to handle large bottles of beverage such as the two liter size and up. The particular carrier of the applicants' design is manufactured in the preferred embodiment as a two-pack carrier but it is within the spirit and scope of the invention that the carrier could be expanded to cover three or more bottles as the purchaser may desire.

The applicants' crown support carrier comprises basically an elongated inverted V-shaped upper section having bottle neck receiving openings positioned in the V-shaped section and having a pair of side walls hingedly attached to the inverted V-shaped upper section and a pair of end walls hingedly attached to the pair of side walls. The side walls and end walls thereby provide ample customer graphic area on all four sides of the carrier and the particular design as shown in the preferred embodiment to be described hereinafter allows the applicants' carton to be manufactured of lighter board caliber thereby resulting in a less expensive carrier cost.

Accordingly, an object and advantage of the invention is to provide a crown support carrier having improved strength resulting from the particular folding arrangement of the carrier resulting in lighter paperboard caliber being used in the carrier production blank.

Another object and advantage of the invention is to provide an improved crown support carrier having increased graphic area on all four sides of the carrier.

These and other objects and advantages of the invention will become apparent from a review of the description of the preferred embodiment hereinafter described in this specification and from a study of the drawings attached to the application.

BRIEF DESCRIPTION OF THE DRAWINGS

FIG. 3 is a plan view of the production blank for the applicants' carrier utilized in the preferred embodiment;

DESCRIPTION OF THE PREFERRED EMBODIMENT

Figure 1:
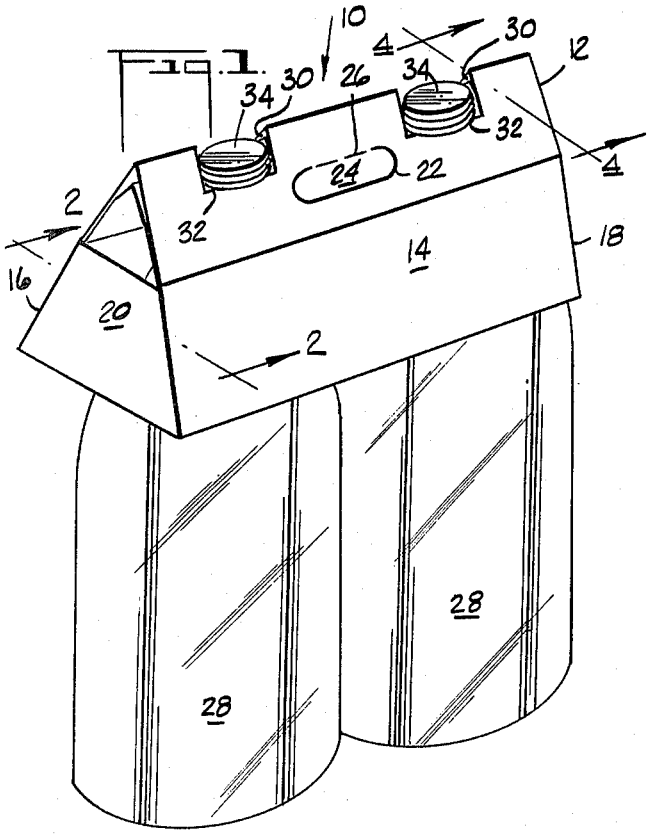
FIG. 1 is a perspective view of the applicants' novel crown support carrier showing a plurality of bottles positioned within the set up carrier.

Referring now to FIG. 1 of the drawing there is shown a perspective view of the applicants' new and improved crown support beverage carrier showing a plurality of beverage bottles positioned in the folded end erected carrier. The applicants' carrier is shown generally by the numeral 10 and comprises an elongated inverted outer V-shaped upper section 12 having hingedly attached thereto a pair of side walls 14 and 16. The side wall 14 has hingedly attached thereto a pair of end walls 18 and 20.

A handle opening 22 is formed in the outer V-shaped upper section 12 and is formed by the use of handle tabs 24 hingedly attached to the outer V-shaped upper section 12 by means of the scoreline 26 as is known in the art of forming handle openings. The bottles 28 contained in the carrier are fixedly held therein by means of an inverted V-shaped neck receiving opening 30 formed on each side of the handle opening 22. The neck openings 30 are designed with edges 32 which engage the bottom surfaces of the bottle sealing caps 34 to firmly and tightly retain the bottles 28 in the carrier 10.

Figure 2:
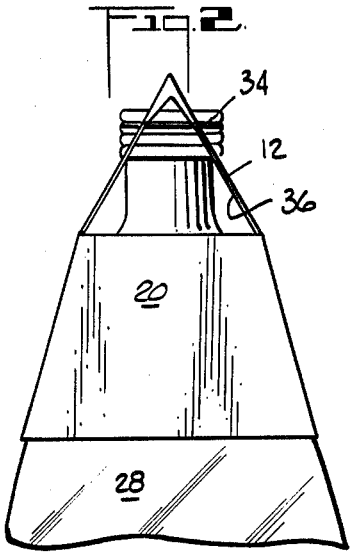
FIG. 2 is a partial end view, taken along line 2—2 of FIG. 1, showing the positioning of the sealing caps in relation to the inverted V-shaped neck receiving openings utilized in the applicants' carrier.

By referring to FIG. 2 of the drawing there can be seen in somewhat greater detail the inverted V-shaped neck openings 30 and also how in the preferred embodiment carrier shown in FIG. 2 that the inverted V-shaped upper section is formed with a second or inner inverted V-shaped section 36 which is adhesively secured to the first or outer inverted V-shaped section 12 and provides a double thickness edge 32 which is utilized to engage the lower edges of the bottle caps 34. The end wall panels 18 and 20 also act to retain the bottles 28 within the carrier 10 from end to end motion whenever the carrier 10 is transported by the customer thereby minimizing bottle drop-out from the inner and outer inverted V-shaped retaining sections.

Referring now to FIG. 3 of the drawing there is shown the production blank of the applicants' new and improved crown support carrier showing the various panels positioned in regard to each other and comprises a first inner side wall panel 38 hingedly attached to the side wall panel 16 by means of the scoreline 40. The side wall panel 16 will be called hereinafter the first outer side wall panel for purposes of clarification and for referral to the applicants' claims relating to the production blank. The first outer side wall panel 16 is hingedly attached to a first upper outer panel section 42 by means of the scoreline 44. The first upper outer panel section 42 is hingedly attached to a second upper outer panel section 46 by means of the scoreline 48. The first upper outer panel section 42 and the second upper outer panel section 46 have formed therein the before mentioned handle openings 22 by means of the handle tab 24 hingedly attached to the respective panels by the scoreline 26. The first and second upper outer panel sections 42 and 46 also have formed therein the inverted V-shaped neck opening 30 previously mentioned which contains the edges 32 utilized to retain the bottle caps 34 in the carrier 10.

A side wall panel 14 is hingedly attached to the second upper outer panel section 46 by means of the scoreline 50 and the side wall panel 14 will hereinafter be called the second outer side wall panel. The second outer side wall panel 14 has hingedly attached thereto an end wall panel 18 by means of the scoreline 52 and also an end wall panel 20 by means of the scoreline 54. The end wall panels 18 and 20 have hingedly attached thereto glue flaps 56 and 58 by means of the scorelines 60 and 62. The end wall panels 18 and 20 also have formed therein, in the center section thereof, a plurality of scorelines 64, 66 and 68 which are utilized to allow the end wall panels 18 and 20 to be folded whenever the carton is erected prior to the insertion of the bottles 28 into the carrier. When the carrier is erected as shown in FIGS. 1 and 2 of the drawing the glue flaps 56 and 58 would be adhesively secured to the first outer side panel 16 which will be described more fully hereinafter when referring to FIG. 5 of the drawing.

A second inner side wall panel 70 is hingedly attached to the second outer side wall panel 14 by means of the scoreline 72 and a first upper inner panel section 74 is hingedly attached to the second inner side wall panel 70 by means of the scoreline 76. A first elongated inner panel section 78 is hingedly attached to the first upper inner panel section 74 by means of the scoreline 80 and a second elongated inner panel section 82 is hingedly attached to the first elongated inner panel section 78 by means of the scoreline 84. A second upper inner panel section 86 is hingedly attached to the second elongated inner panel section 82 by means of the scoreline 88 completing the various panels of the carrier. A second inverted V-shaped neck opening 90 is formed in the first elongated inner panel section 78 and the second elongated inner panel section 82 and is spaced on either side of the handle openings 22 formed by means of the handle tabs 24 hinged by the scoreline 26 as has been previously mentioned.

When the production blank is formed thusly, it can be seen how the carrier when erected comprises in the preferred embodiment double thickness side walls and double thickness elongated inverted V-shaped upper sections which allows the carrier to be constructed of lighter board caliber thereby reducing the ultimate cost of the carrier. By referring to FIG. 4 of the drawing there can be seen how the various panels are laminated together to provide the double thickness sections before mentioned. The first inner side wall panel 38 is laminated to the first outer side wall panel 16 while the second inner side wall panel 70 is laminated to the second outer side wall panel 14. In a similar manner the first upper outer panel section 42 is partially laminated to the second upper inner panel section 86 while the second upper outer panel section 46 is partially laminated to the first upper inner panel section 74.

Figure 4:
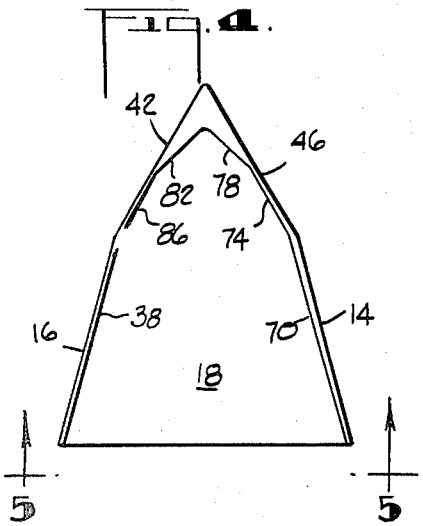
FIG. 4 is a sectional view, taken along line 4—4 of FIG. 1, showing the double thickness construction in the elongated inverted V-shaped upper section of the applicants' carrier.
Figure 5:
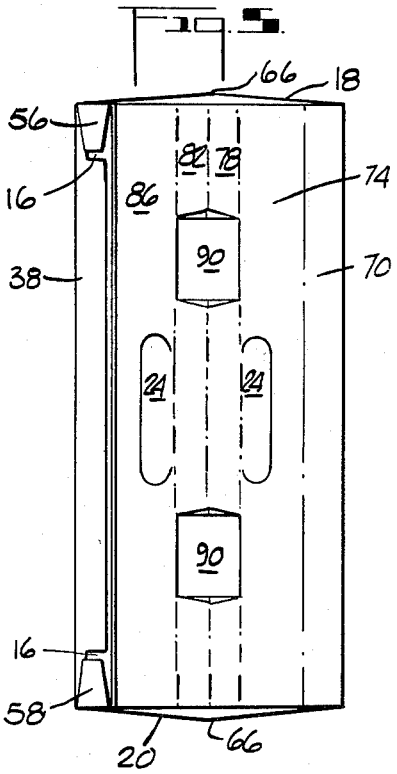
FIG. 5 is a bottom view, taken along line 5—5 of FIG. 4 showing the internal folding of the applicants' carrier.

Referring now to FIG. 5 of the drawing there is shown a bottom view, taken along line 5—5 of FIG. 4, showing the respective panels laminated together and also showing how the end wall panels 18 and 20 would be glued to the first outer side wall panel 16 as has been before mentioned. For purposes of clarity, the end wall panels 18 and 20 are shown folded outwardly somewhat about their respective scorelines 66.

From the foregoing it can be seen that there has been provided by the subject invention a new and improved crown support carrier having all of the objects and advantages incorporated therein. Nevertheless it is apparent from a study of this application that changes may be made in the embodiment shown and in the arrangement of the various panels without departing from the spirit and scope of the invention which is not to be limited to the embodiments shown which has been shown by way of illustration only.

Having described our invention, we claim:

1. A production blank for a crown support beverage carrier comprising:

(a) a first inner side wall panel;

(b) a first outer side wall panel hingedly attached to the first inner side wall panel;

(c) a first upper outer panel section hingedly attached to the first outer side wall panel and having formed therein a handle opening;

(d) a second upper outer panel section hingedly attached to the first upper outer panel section and having formed therein a handle opening, the first upper outer panel section and the second upper outer panel section having formed therein and lying therebetween at least two bottle neck receiving openings;

(e) a second outer side wall panel hingedly attached to the second upper outer panel section and having formed thereon, on each side thereof an end wall panel, each end wall panel having formed thereon a glue flap;

(f) a second inner side wall panel hingedly attached to the second outer side wall panel;

(g) a first upper inner panel section hingedly attached to the second inner side wall panel and having formed thereon a handle opening;

(h) a first elongated inner panel section hingedly attached to the first upper inner panel section;

(i) a second elongated inner panel section hingedly attached to the first elongated inner panel section, the first and second inner panel sections having formed thereon and positioned therebetween at least two bottle neck receiving openings; and (j) a second upper inner panel section hingedly attached to the second elongated inner panel section and having formed thereon a handle opening.

2. The production blank as defined in claim 1 further comprising the handle openings formed in the first upper outer panel section, the second upper outer panel section, the first upper inner panel section and the second upper inner panel section having formed thereon handle tabs.

* * * * *